US010733974B2

(12) United States Patent
Tan et al.

(10) Patent No.: US 10,733,974 B2
(45) Date of Patent: Aug. 4, 2020

(54) SYSTEM AND METHOD FOR SYNTHESIS OF SPEECH FROM PROVIDED TEXT

(71) Applicant: INTERACTIVE INTELLIGENCE GROUP, INC., Indianapolis, IN (US)

(72) Inventors: Yingyi Tan, Carmel, IN (US); Aravind Ganapathiraju, Hyderabad (IN); Felix Immanuel Wyss, Zionsville, IN (US)

( * ) Notice: Subject to any disclaimer, the term of this patent is extended or adjusted under 35 U.S.C. 154(b) by 0 days.

(21) Appl. No.: 15/874,612

(22) Filed: Jan. 18, 2018

(65) Prior Publication Data

US 2018/0144739 A1 May 24, 2018

Related U.S. Application Data

(63) Continuation of application No. 14/596,628, filed on Jan. 14, 2015, now Pat. No. 9,911,407.

(60) Provisional application No. 61/927,152, filed on Jan. 14, 2014.

(51) Int. Cl.
*G10L 13/00* (2006.01)
*G10L 13/08* (2013.01)

(52) U.S. Cl.
CPC ..... *G10L 13/08* (2013.01)

(58) Field of Classification Search
USPC ..... 704/257–275
See application file for complete search history.

(56) References Cited

U.S. PATENT DOCUMENTS 6,014,621 A 1/2000 Chen
6,567,777 B1 * 5/2003 Chatterjee ..... G10L 15/02 704/246
6,961,704 B1 11/2005 Phillips et al.
7,103,548 B2 * 9/2006 Squibbs ..... H04M 1/72544 704/260
7,136,816 B1 * 11/2006 Strom ..... G10L 13/10 704/260
7,680,651 B2 3/2010 Tammi et al.
2002/0120450 A1 * 8/2002 Junqua ..... G10L 13/04 704/258
2002/0193994 A1 * 12/2002 Kibre ..... G10L 13/047 704/260

(Continued)

FOREIGN PATENT DOCUMENTS

JP 2008242317 A 10/2008
JP 2010237323 A 10/2010
WO 2015134452 A1 9/2015

OTHER PUBLICATIONS

Toda et al. "A Speech Parameter Generation Algorithm Considering Global Variance for HMM-Based Speech Synthesis". IEICE Trans. Inf. & Syst., vol. E90-D, No. 5 May 2007, pp. 816-824.*

(Continued)

*Primary Examiner* — Jesse S Pullias

(57) ABSTRACT

A system and method are presented for the synthesis of speech from provided text. Particularly, the generation of parameters within the system is performed as a continuous approximation in order to mimic the natural flow of speech as opposed to a step-wise approximation of the feature stream. Provided text may be partitioned and parameters generated using a speech model. The generated parameters from the speech model may then be used in a post-processing step to obtain a new set of parameters for application in speech synthesis.

8 Claims, 6 Drawing Sheets

(56) References Cited

U.S. PATENT DOCUMENTS

| | | | | |
|---|---|---|---|---|
| 2003/0028377 | A1* | 2/2003 | Noyes | G10L 13/033 704/258 |
| 2003/0163314 | A1 | 8/2003 | Junqua | |
| 2005/0071163 | A1 | 3/2005 | Aaron et al. | |
| 2005/0182629 | A1 | 8/2005 | Coorman et al. | |
| 2006/0074672 | A1* | 4/2006 | Allefs | G10L 13/033 704/258 |
| 2006/0095265 | A1* | 5/2006 | Chu | G10L 13/033 704/268 |
| 2008/0243508 | A1 | 10/2008 | Masuko et al. | |
| 2010/0030557 | A1* | 2/2010 | Molloy | G10L 13/00 704/235 |
| 2012/0065961 | A1* | 3/2012 | Latorre | G10L 13/07 704/9 |
| 2012/0143611 | A1* | 6/2012 | Qian | G10L 13/07 704/260 |
| 2012/0221339 | A1 | 8/2012 | Wang et al. | |
| 2012/0239406 | A1* | 9/2012 | Langehoveen Brummer | G10L 21/00 704/264 |
| 2013/0066631 | A1 | 3/2013 | Wu et al. | |
| 2013/0262087 | A1 | 10/2013 | Ohtani | |

OTHER PUBLICATIONS

Extended European Search Report for corresponding EP Application No. 15737007.3, dated Aug. 11, 2017 (15 pages).

International Search Report and Written Opinion of the International Searching Authority, dated Jun. 11, 2015 in related International Application PCT/US15/11348, filed Jan. 14, 2015.

Junichi "An Introduction to HMM-Based Speech Synthesis" In: Technical report, Tokyo Institute of Technology, Oct. 2006.

Kang, et al. "Applying pitch target model to convert F0 contour for expressive Mandarin speech synthesis". Proc. ICASSP 2006, p. 733-736.

King, Simon, "A Beginners' Guide to Statistical Parametric Speech Analysis," The Centre for Speech Technology Research, University of Edinburgh, UK, Jun. 24, 2010.

Zen, et al., "Statistical parametric speech synthesis," Speech Communication, Elsevier Science Publishers, vol. 51, No. 11, Nov. 1, 2009, pp. 1039-1064.

Chilean Office Action for Application No. 201602219, dated May 14, 2018, 6 pages.

Chilean First Office Action for Application No. 01802-2016, dated Mar. 12, 2018, 12 pages.

Japanese Office Action with English Translation for Application No. 2016-542126, dated May 22, 2018, 11 pages.

Silen, Hanna, et al., Ways to Implement Global Variance in Statistical Speech Synthesis, Interspeech 2012, USA, ISCA, Sep. 13, 2012, pp. 1436-1439, [online], [Jun. 5, 2018 Search].

Chilean Office Action for Application No. 201601802, dated Sep. 14, 2018, 13 pages.

Australian Government Examination Report No. 1 for Application No. 2015206631, dated Jun. 27, 2019, 4 pages.

Japanese Office Action with English Translation for Application No. 2016-542126, dated Apr. 23, 2019, 4 pages.

* cited by examiner

--Prior Art--

SYSTEM AND METHOD FOR SYNTHESIS OF SPEECH FROM PROVIDED TEXT

CROSS-REFERENCE TO RELATED APPLICATIONS

This application is a continuation of U.S. application Ser. No. 14/596,628, filed on Jan. 14, 2015, which claims priority and benefit of U.S. Provisional Application No. 61/927,152, filed on Jan. 14, 2014, the contents of both of which are incorporated herein by reference.

BACKGROUND

The present invention generally relates to telecommunications systems and methods, as well as speech synthesis. More particularly, the present invention pertains to synthesizing speech from provided text using parameter generation.

SUMMARY

A system and method are presented for the synthesis of speech from provided text. Particularly, the generation of parameters within the system is performed as a continuous approximation in order to mimic the natural flow of speech as opposed to a step-wise approximation of the parameter stream. Provided text may be partitioned and parameters generated using a speech model. The generated parameters from the speech model may then be used in a post-processing step to obtain a new set of parameters for application in speech synthesis.

In one embodiment, a system is presented for synthesizing speech for provided text comprising: means for generating context labels for said provided text; means for generating a set of parameters for the context labels generated for said provided text using a speech model; means for processing said generated set of parameters, wherein said means for processing is capable of variance scaling; and means for synthesizing speech for said provided text, wherein said means for synthesizing speech is capable of applying the processed set of parameters to synthesizing speech.

In another embodiment, a method for generating parameters, using a continuous feature stream, for provided text for use in speech synthesis, is presented, comprising the steps of: partitioning said provided text into a sequence of phrases; generating parameters for said sequence of phrases using a speech model; and processing the generated parameters to obtain an other set of parameters, wherein said other set of parameters are capable of use in speech synthesis for provided text.

DETAILED DESCRIPTION

Figure 1:
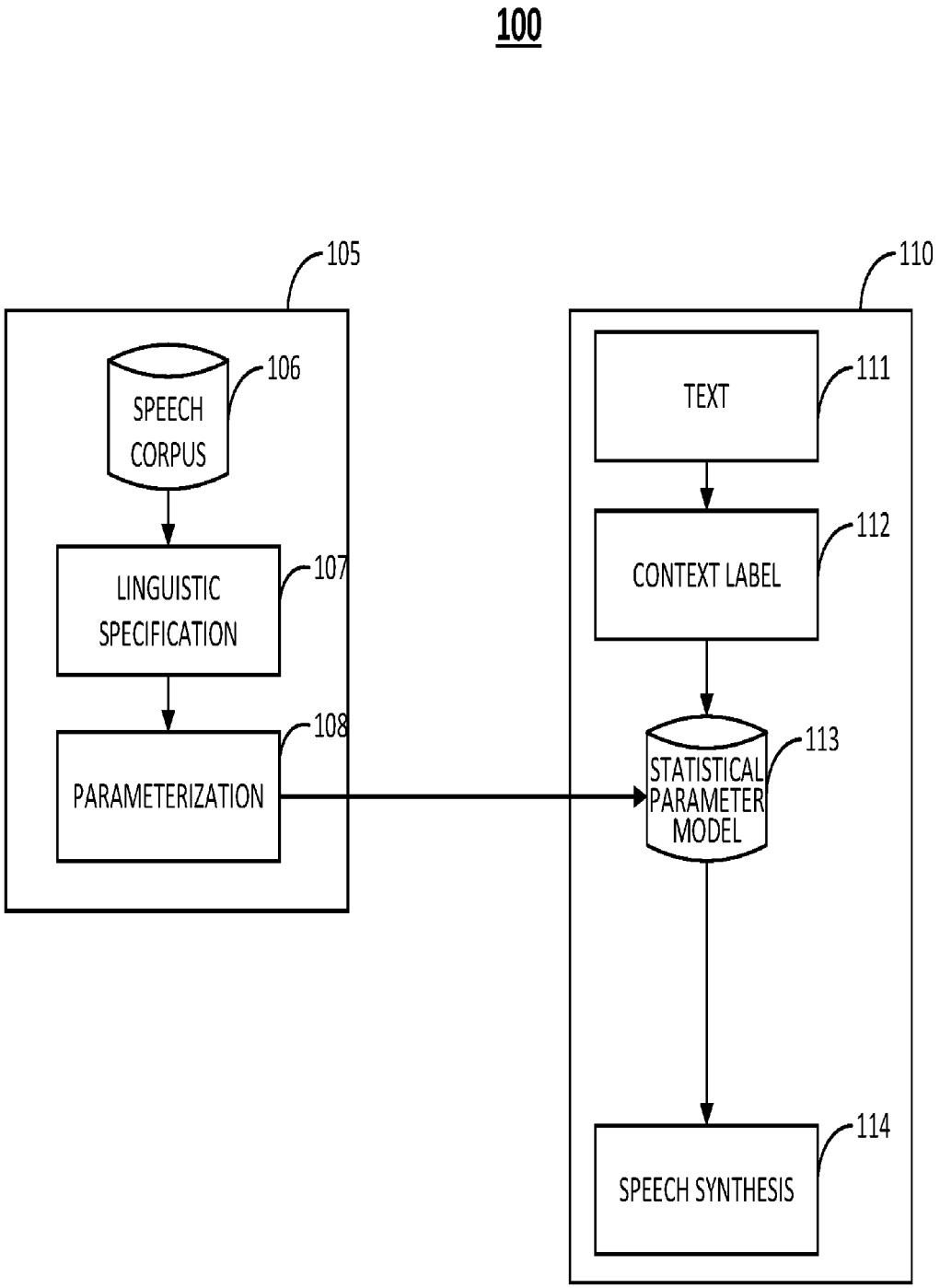
FIG. 1 is a diagram illustrating an embodiment of a system for synthesizing speech.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In a traditional text-to-speech (TTS) system, written language, or text, may be automatically converted into linguistic specification. The linguistic specification indexes the stored form of a speech corpus, or the model of speech corpus, to generate speech waveform. A statistical parametric speech system does not store any speech itself, but the model of speech instead. The model of the speech corpus and the output of the linguistic analysis may be used to estimate a set of parameters which are used to synthesize the output speech. The model of the speech corpus includes mean and covariance of the probability function that the speech parameters fit. The retrieved model may generate spectral parameters, such as fundamental frequency (f0) and mel-cepstral (MCEPs), to represent the speech signal. These parameters, however, are for a fixed frame rate and are derived from a state machine. A step-wise approximation of the parameter stream results, which does not mimic the natural flow of speech. Natural speech is continuous and not step-wise. In one embodiment, a system and method are disclosed that converts the step-wise approximation from the models to a continuous stream in order to mimic the natural flow of speech.

FIG. 1 is a diagram illustrating an embodiment of a traditional system for synthesizing speech, indicated generally at 100. The basic components of a speech synthesis system may include a training module 105, which may comprise a speech corpus 106, linguistic specifications 107, and a parameterization module 108, and a synthesizing module 110, which may comprise text 111, context labels 112, a statistical parametric model 113, and a speech synthesis module 114.

The training module 105 may be used to train the statistical parametric model 113. The training module 105 may comprise a speech corpus 106, linguistic specifications 107, and a parameterization module 108. The speech corpus 106 may be converted into the linguistic specifications 107. The speech corpus may comprise written language or text that has been chosen to cover sounds made in a language in the context of syllables and words that make up the vocabulary of the language. The linguistic specification 107 indexes the stored form of speech corpus or the model of speech corpus to generate speech waveform. Speech itself is not stored, but the model of speech is stored. The model includes mean and the covariance of the probability function that the speech parameters fit.

The synthesizing module 110 may store the model of speech and generate speech. The synthesizing module 110 may comprise text 111, context labels 112, a statistical parametric model 113, and a speech synthesis module 114. Context labels 112 represent the contextual information in the text 111 which can be of a varied granularity, such as information about surrounding sounds, surrounding words, surrounding phrases, etc. The context labels 112 may be generated for the provided text from a language model. The statistical parametric model 113 may include mean and covariance of the probability function that the speech parameters fit.

The speech synthesis module 114 receives the speech parameters for the text 111 and transforms the parameters into synthesized speech. This can be done using standard methods to transform spectral information into time domain signals, such as a mel log spectrum approximation (MLSA) filter.

Figure 2:
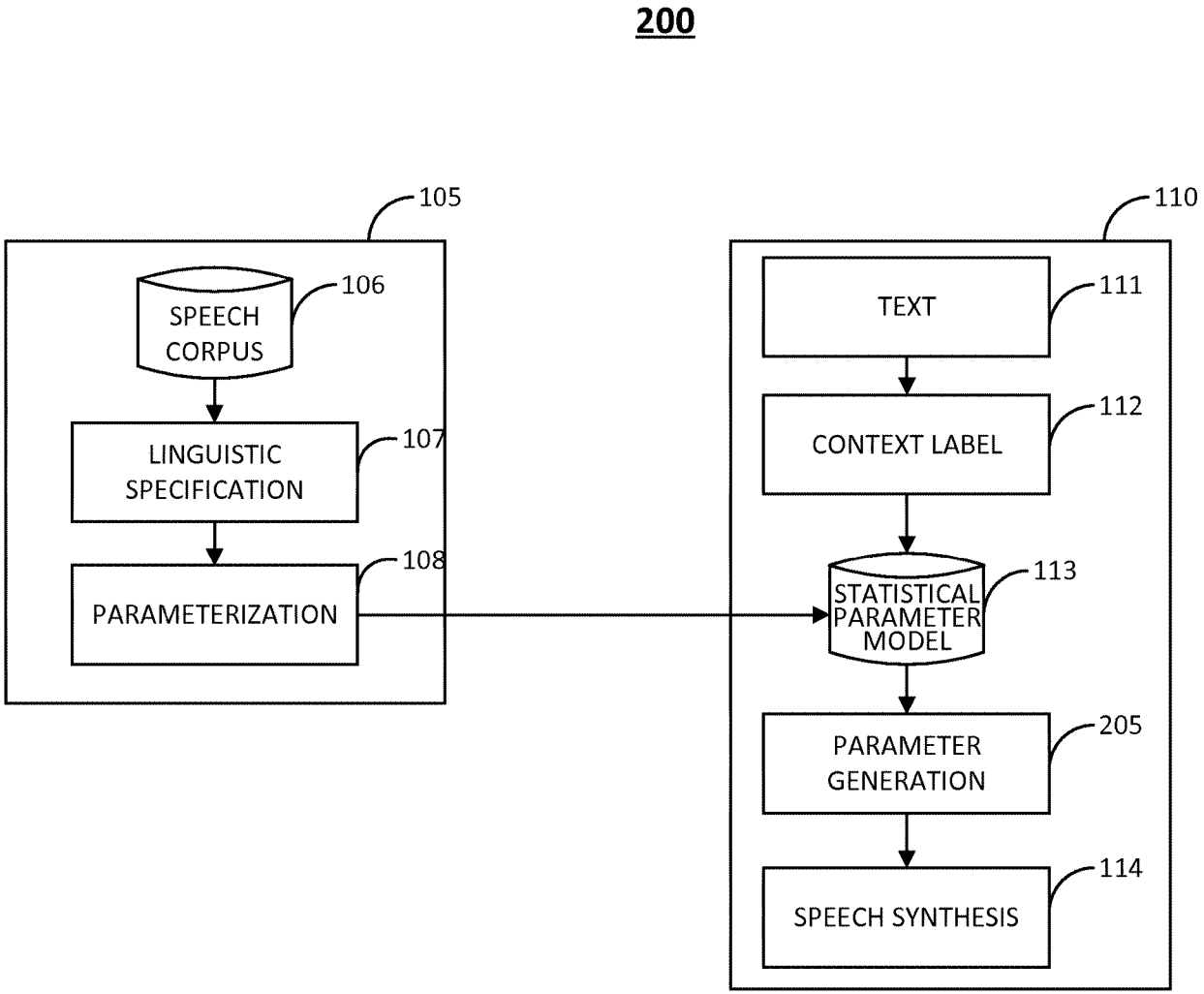
FIG. 2 is a diagram illustrating a modified embodiment of a system for synthesizing speech.

FIG. 2 is a diagram illustrating a modified embodiment of a system for synthesizing speech using parameter generation, indicated generally at 200. The basic components of a system may include similar components to those in FIG. 1, with the addition of a parameter generation module 205. In a statistical parametric speech synthesis system, the speech signal is represented as a set of parameters at some fixed frame rate. The parameter generation module 205 receives the audio signal from the statistical parameter model 113 and transforms it. In an embodiment, the audio signal in the time domain has been mathematically transformed to another domain, such as the spectral domain, for more efficient processing. The spectral information is then stored as the form of frequency coefficients, such as f0 and MCEPs to represent the speech signal. Parameter generation is such that it has an indexed speech model as input and the spectral parameters as output. In one embodiment, Hidden Markov Model (HMM) techniques are used. The model 113 includes not only the statistical distribution of parameters, also called static coefficients, but also their rate of change. The rate of change may be described as having first-order derivatives called delta coefficients and second-order derivatives referred to as deltadelta coefficients. The three types of parameters are stacked together into a single observation vector for the model. The process of generating parameters is described in greater detail below.

In the traditional statistical model of the parameters, only the mean and the variance of the parameter are considered. The mean parameter is used for each state to generate parameters. This generates piecewise constant parameter trajectories, which change value abruptly at each state transition, and is contrary to the behavior of natural sound. Further, the statistical properties of the static coefficient are only considered and not the speed with which the parameters change value. Thus, the statistical properties of the first- and second-order derivatives must be considered, as in the modified embodiment described in FIG. 2.

Maximum likelihood parameter generation (MLPG) is a method that considers the statistical properties of static coefficients and the derivatives. However, this method has a great computational cost that increases with the length of the sequence and thus is impractical to implement in a real-time system. A more efficient method is described below which generates parameters based on linguistic segments instead of whole text message. A linguistic segment may refer to any group of words or sentences which can be separated by context label "pause" in a TTS system.

Figure 3:
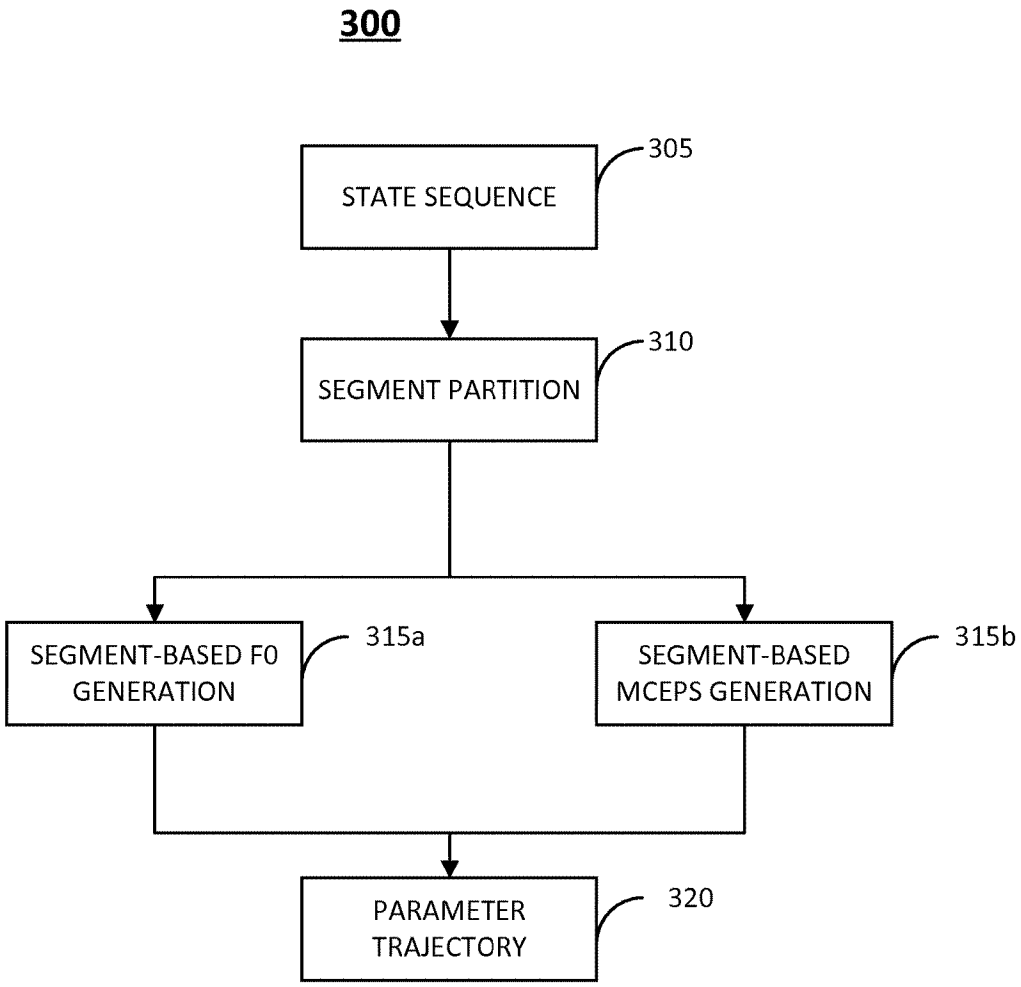
FIG. 3 is a flowchart illustrating an embodiment of parameter generation.

FIG. 3 is a flowchart illustrating an embodiment of generating parameter trajectories, indicated generally at 300. Parameter trajectories are generated based on linguistic segments instead of whole text message. Prior to parameter generation, a state sequence may be chosen using a duration model present in the statistical parameter model 113. This determines how many frames will be generated from each state in the statistical parameter model. As hypothesized by the parameter generation module, the parameters do not vary while in the same state. This trajectory will result in a poor quality speech signal. However, if a smoother trajectory is estimated using information from delta and delta-delta parameters, the speech synthesis output is more natural and intelligible.

In operation 305, the state sequence is chosen. For example, the state sequence may be chosen using the statistical parameter model 113, which determines how many frames will be generated from each state in the model 113. Control passes to operation 310 and process 300 continues.

In operation 310, segments are partitioned. In one embodiment, the segment partition is defined as a sequence of states encompassed by the pause model. Control is passed to at least one of operations 315*a* and 315*b* and process 300 continues.

In operations 315*a* and 315*b*, spectral parameters are generated. The spectral parameters represent the speech signal and comprise at least one of the fundamental frequency 315*a* and MCEPs, 315*b*. These processes are described in greater detail below in FIGS. 5 and 6. Control is passed to operation 320 and process 300 continues.

Figure 4:
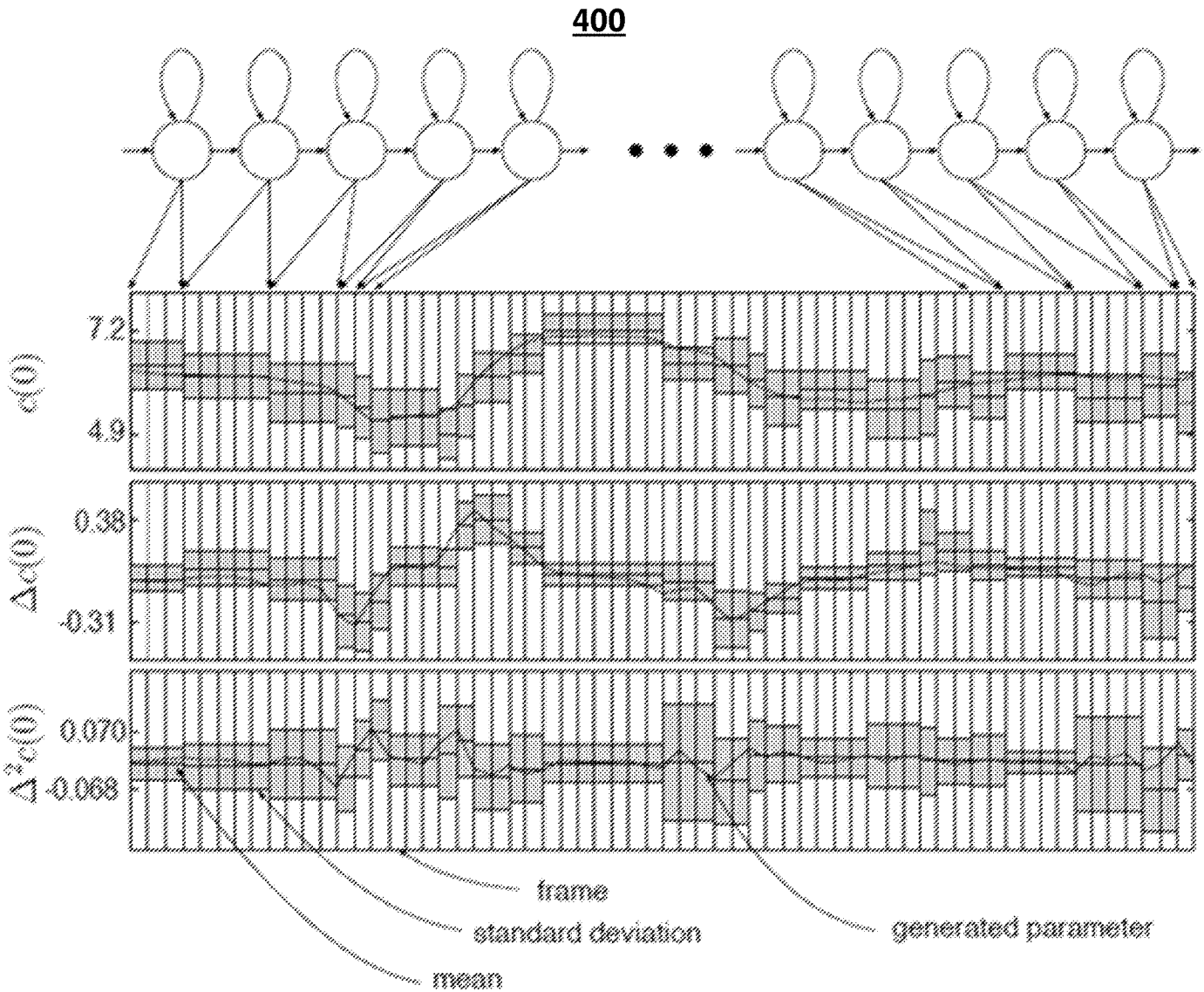
FIG. 4 is a diagram illustrating an embodiment of a generated parameter.

In operation 320, the parameter trajectory is created. For example, the parameter trajectory may be created by concatenating each parameter stream across all states along the time domain. In effect each dimension in the parametric model will have a trajectory. An illustration of a parameter trajectory creation for one such dimension is provided generally in FIG. 4. FIG. 4 (copied from: KING, Simon, "A beginners' guide to statistical parametric speech synthesis" The Centre for Speech Technology Research, University of Edinburgh, UK, 24 Jun. 2010, page 9) is a generalized embodiment of a trajectory from MLPG that has been smoothed.

Figure 5:
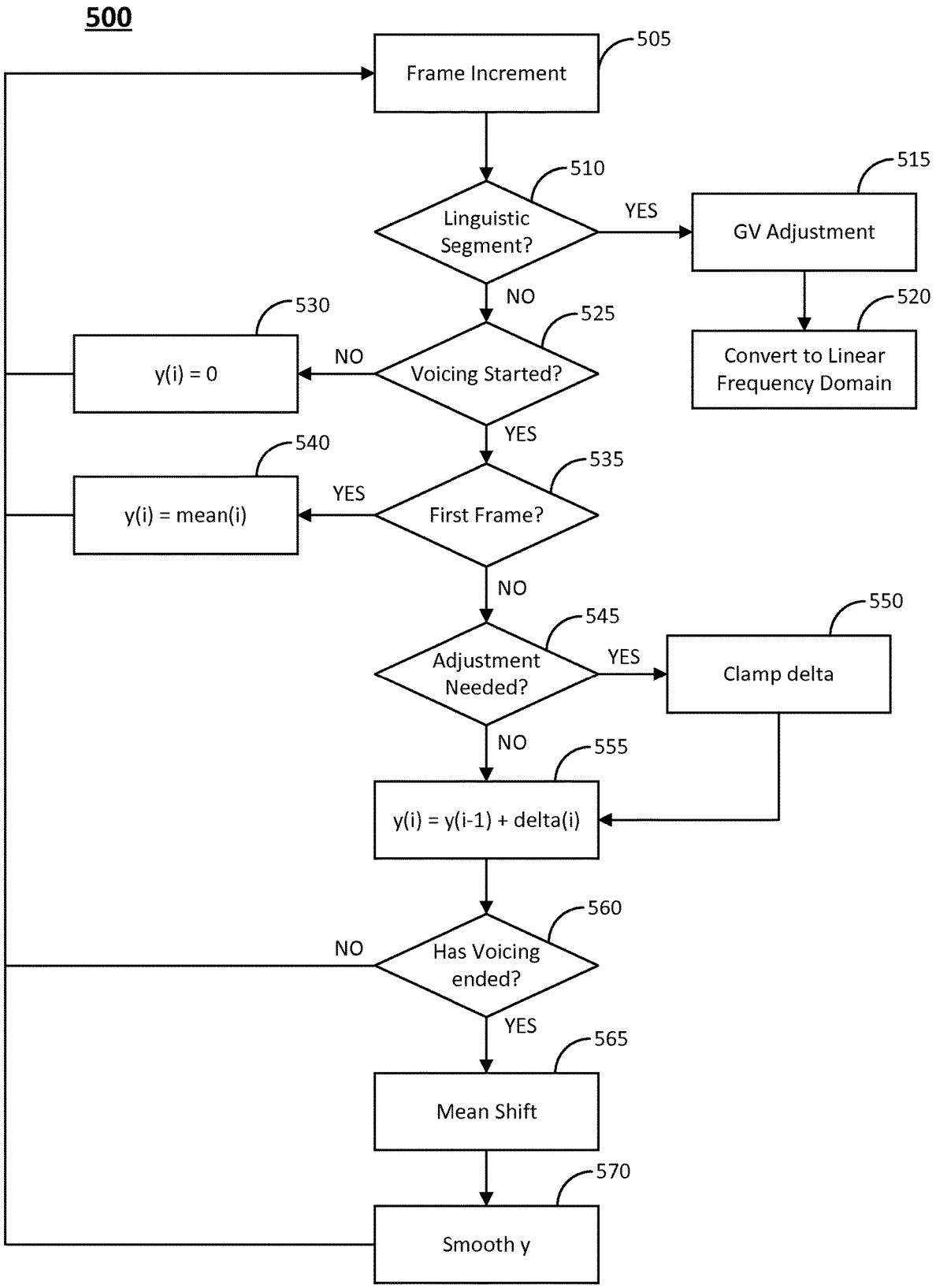
FIG. 5 is a flowchart illustrating an embodiment of a process for f0 parameter generation.

FIG. 5 is a flowchart illustrating an embodiment of a process for fundamental spectral parameter generation, indicated generally at 500. The process may occur in the parameter generation module 205 (FIG. 2) after the input text is split into linguistic segments. Parameters are predicted for each segment.

In operation 505, the frame is incremented. For example, a frame may be examined for linguistic segments which may contain several voiced segments. The parameter stream may be based on frame units such that i=1 represents the first frame, i=2 represents the second frame, etc. For frame incrementing, the value for "i" is increased by a desired interval. In an embodiment, the value for "i" may be increased by 1 each time. Control is passed to operation 510 and the process 500 continues.

In operation 510, it is determined whether or not linguistic segments are present in the signal. If it is determined those linguistic segments are present, control is passed to operation 515 and process 500 continues. If it is determined that linguistic segments are not present, control is passed to operation 525 and the process 500 continues.

The determination in operation 510 may be made based on any suitable criteria. In one embodiment, the segment partition of the linguistic segments is defined as a sequence of states encompassed by the pause model.

In operation 515, a global variance adjustment is performed. For example, the global variance may be used to adjust the variance of the linguistic segment. The f0 trajectory may tend to have a smaller dynamic range compared to natural sound due to the use of the mean of the static coefficient and the delta coefficient in parameter generation. Variance scaling may expand the dynamic range of the f0 trajectory so that the synthesized signal sounds livelier. Control is passed to operation 520 and process 500 continues.

In operation 520, a conversion to the linear frequency domain is performed on the fundamental frequency from the log domain and the process 500 ends.

In operation 525, it is determined whether or not the voicing has started. If it is determined that the voicing has not started, control is passed to operation 530 and the process 500 continues. If it is determined that voicing has started, control is passed to operation 535 and the process 500 continues.

The determination in operation 525 may be based on any suitable criteria. In an embodiment, when the f0 model predicts valid values for f0, the segment is deemed a voiced segment and when the f0 model predicts zeros, the segment is deemed an unvoiced segment.

In operation 530, the frame has been determined to be unvoiced. The spectral parameter for that frame is 0 such that f0(i)=0. Control is passed back to operation 505 and the process 500 continues.

In operation 535, the frame has been determined to be voiced and it is further determined whether or not the voicing is in the first frame. If it is determined that the voicing is in the first frame, control is passed to operation 540 and process 500 continues. If it is determined that the voicing is not in the first frame, control is passed to operation 545 and process 500 continues.

The determination in operation 535 may be based on any suitable criteria. In one embodiment it is based on predicted f0 values and in another embodiment it could be based on a specific model to predict voicing.

In operation 540, the spectral parameter for the first frame is the mean of the segment such that f0(i)=f0_mean(i). Control is passed back to operation 505 and the process 500 continues.

In operation 545, it is determined whether or not the delta value needs to be adjusted. If it is determined that the delta value needs adjusted, control is passed to operation 550 and the process 500 continues. If it is determined that the delta value does not need adjusted, control is passed to operation 555 and the process 500 continues.

The determination in operation 545 may be based on any suitable criteria. For example, an adjustment may need to be made in order to control the parameter change for each frame to a desired level.

In operation 550, the delta is clamped. The f0_deltaMean (i) may be represented as f0_new_deltaMean(i) after clamping. If clamping has not been performed, then the f0_new_deltaMean(i) is equivalent to f0_deltaMean(i). The purpose of clamping the delta is to ensure that the parameter change for each frame is controlled to a desired level. If the change is too large, and say lasts over several frames, the range of the parameter trajectory will not be in the desired natural sound's range. Control is passed to operation 555 and the process 500 continues.

In operation 555, the value of the current parameter is updated to be the predicted value plus the value of delta for the parameter such that f0(i)=f0(i−1)+f0_new_deltaMean(i). This helps the trajectory ramp up or down as per the model. Control is then passed to operation 560 and the process 500 continues.

In operation 560, it is determined whether or not the voice has ended. If it is determined that the voice has not ended, control is passed to operation 505 and the process 500 continues. If it is determined that the voice has ended, control is passed to operation 565 and the process 500 continues.

The determination in operation 560 may be determined based on any suitable criteria. In an embodiment the f0 values becoming zero for a number of consecutive frames may indicate the voice has ended.

In operation 565, a mean shift is performed. For example, once all of the voiced frames, or voiced segments, have ended, the mean of the voice segment may be adjusted to the desired value. Mean adjustment may also bring the parameter trajectory come into the desired natural sound's range. Control is passed to operation 570 and the process 500 continues.

In operation 570, the voice segment is smoothed. For example, the generated parameter trajectory may have abruptly changed somewhere, which makes the synthesized speech sound warble and jumpy. Long window smoothing can make the f0 trajectory smoother and the synthesized speech sound more natural. Control is passed back to operation 505 and the process 500 continues. The process may continuously cycle any number of times that are necessary. Each frame may be processed until the linguistic segment ends, which may contain several voiced segments. The variance of the linguistic segment may be adjusted based on global variance. Because the mean of static coefficients and delta coefficients are used in parameter generation, the parameter trajectory may have smaller dynamic ranges compared to natural sound. A variance scaling method may be utilized to expand the dynamic range of the parameter trajectory so that the synthesized signal does not sound muffled. The spectral parameters may then be converted from the log domain into the linear domain.

Figure 6:
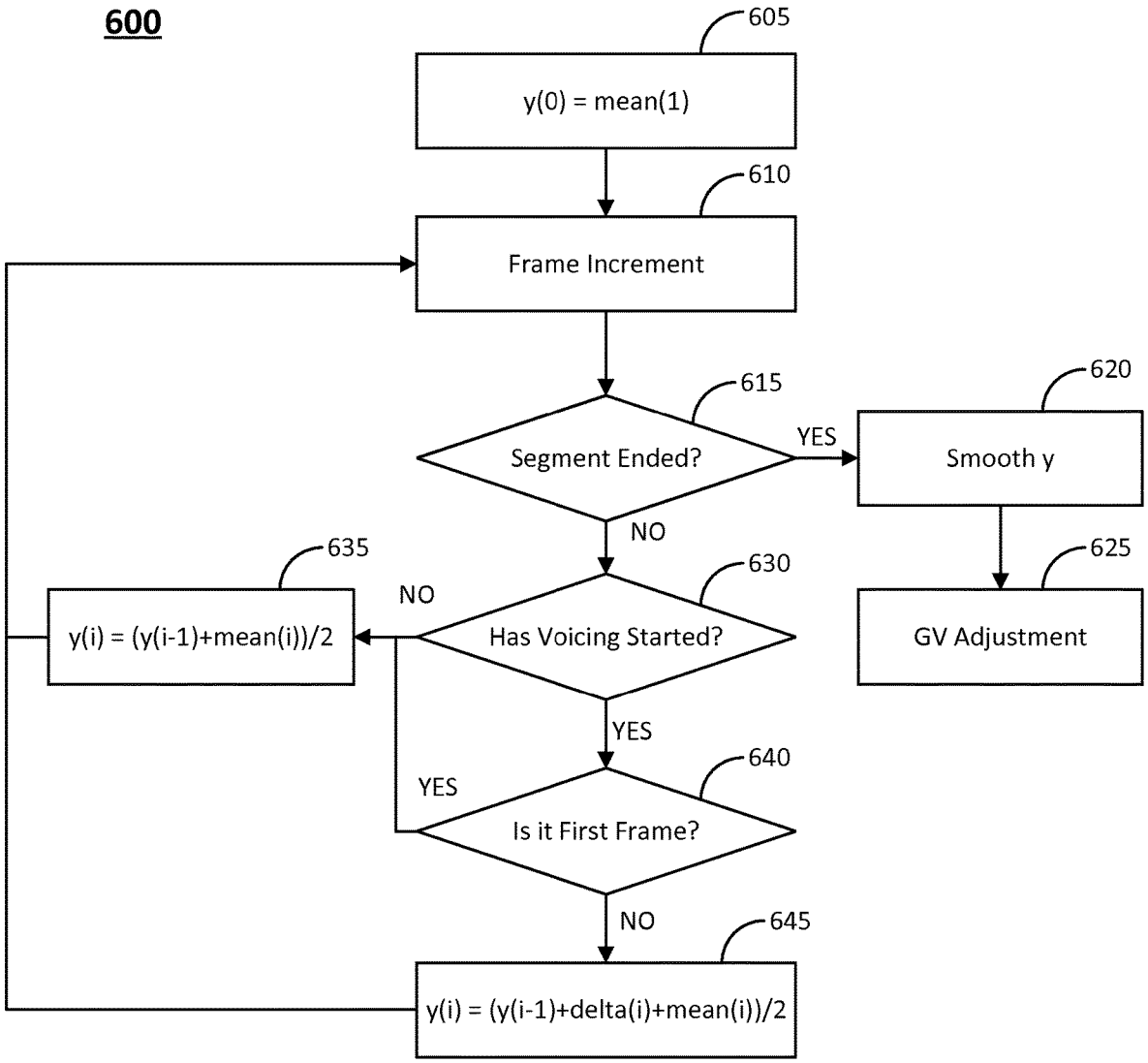
FIG. 6 is a flowchart illustrating an embodiment of a process for MCEPs generation.

FIG. 6 is a flowchart illustrating an embodiment of MCEPs generation, indicated generally at 600. The process may occur in the parameter generation module 205 (FIG. 2).

In operation 605, the output parameter value is initialized. In an embodiment, the output parameter may be initialized at time i=0 because the output parameter value is dependent on the parameter generated for the previous frame. Thus, the initial mcep(0)=mcep_mean(1). Control is passed to operation 610 and the process 600 continues.

In operation 610, the frame is incremented. For example, a frame may be examined for linguistic segments which may contain several voiced segments. The parameter stream may be based on frame units such that i=1 represents the first frame, i=2 represents the second frame, etc. For frame incrementing, the value for "i" is increased by a desired interval. In an embodiment, the value for "i" may be increased by 1 each time. Control is passed to operation 615 and the process 600 continues.

In operation 615, it is determined whether or not the segment is ended. If it is determined that the segment has ended, control is passed to operation 620 and the process 600 continues. If it is determined that the segment has not ended, control is passed to operation 630 and the process continues.

The determination in operation 615 is made using information from linguistic module as well as existence of pause.

In operation 620, the voice segment is smoothed. For example, the generated parameter trajectory may have abruptly changed somewhere, which makes the synthesized speech sound warble and jumpy. Long window smoothing can make the trajectory smoother and the synthesized speech sound more natural. Control is passed to operation 625 and the process 600 continues.

In operation 625, a global variance adjustment is performed. For example, the global variance may be used to adjust the variance of the linguistic segment. The trajectory may tend to have a smaller dynamic range compared to natural sound due to the use of the mean of the static coefficient and the delta coefficient in parameter generation. Variance scaling may expand the dynamic range of the trajectory so that the synthesized signal should not sound muffled. The process 600 ends.

In operation 630, it is determined whether or not the voicing has started. If it is determined that the voicing has not started, control is passed to operation 635 and the process 600 continues. If it is determined that voicing has started, control is passed to operation 540 and the process 600 continues.

The determination in operation 630 may be made based on any suitable criteria. In an embodiment, when the f0 model predicts valid values for f0, the segment is deemed a voiced segment and when the f0 model predicts zeros, the segment is deemed an unvoiced segment.

In operation 635, the spectral parameter is determined. The spectral parameter for that frame becomes mcep(i)=(mcep(i−1)+mcep_mean(i))/2. Control is passed back to operation 610 and the process 600 continues.

In operation 640, the frame has been determined to be voiced and it is further determined whether or not the voice is in the first frame. If it is determined that the voice is in the first frame, control is passed back to operation 635 and process 600 continues. If it is determined that the voice is not in the first frame, control is passed to operation 645 and process 500 continues.

In operation 645, the voice is not in the first frame and the spectral parameter becomes mcep(i)=(mcep(i−1)+mcep_delta(i)+mcep_mean(i))/2. Control is passed back to operation 610 and process 600 continues. In an embodiment, multiple MCEPs may be present in the system. Process 600 may be repeated any number of times until all MCEPs have been processed.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the invention as described herein and/or by the following claims are desired to be protected.

Hence, the proper scope of the present invention should be determined only by the broadest interpretation of the appended claims so as to encompass all such modifications as well as all relationships equivalent to those illustrated in the drawings and described in the specification.

The invention claimed is:

1. A method for synthesizing speech from input text, the method comprising:

generating context labels from the input text, the context labels comprising one or more pause labels;

partitioning the input text into a plurality of linguistic segments in accordance with the one or more pause labels;

generating, for each linguistic segment, a time domain audio signal from the linguistic segment in accordance with a statistical parameter model;

generating, for each linguistic segment, a parameter trajectory from the time domain audio signal, the parameter trajectory comprising a plurality of frames for the linguistic segment, each frame comprising a vector of parameters;

smoothing a transition between a first frame and a second frame of the frames of the parameter trajectory; and synthesizing speech from the parameter trajectory;

wherein the vector of parameters for each frame of the parameter trajectory comprises one or more frequency coefficients, spectral envelope values, delta coefficients, and delta-delta coefficients, and wherein the smoothing the transition between the first frame and the second frame of the frames of the parameter trajectory comprises clamping at least one delta coefficient of the delta coefficients corresponding to the first frame and the second frame.

2. The method of claim 1, wherein the context labels are generated based on linguistic analysis of the input text.

3. The method of claim 1, wherein the frames of the parameter trajectory of the linguistic segment are grouped into a sequence of states, wherein the vectors of parameters for the frames are generated separately for each state of the sequence of states.

4. The method of claim 1, wherein the generating the parameter trajectory comprises transforming the time domain audio signal to a spectral domain.

5. The method of claim 1, wherein the statistical parameter model is trained by:

converting a speech corpus into a linguistic specification, the speech corpus covering sounds made in a language and the linguistic specification indexing the speech corpus to generate a speech waveform based on spectral speech parameters; and generating the statistical parameter model based on the linguistic specification and a mean and covariance of a probability function fit by the spectral speech parameters.

6. A method for synthesizing speech from input text, the method comprising:

generating context labels from the input text, the context labels comprising one or more pause labels;

partitioning the input text into a plurality of linguistic segments in accordance with the one or more pause labels;

generating, for each linguistic segment, a time domain audio signal from the linguistic segment in accordance with a statistical parameter model;

generating, for each linguistic segment, a parameter trajectory from the time domain audio signal, the parameter trajectory comprising a plurality of frames for the linguistic segment, each frame comprising a vector of parameters;

smoothing a transition between a first frame and a second frame of the frames of the parameter trajectory; and synthesizing speech from the parameter trajectory;

wherein the generating the parameter trajectory for a linguistic segment comprises generating a plurality of mel-cepstral coefficients by, for each frame of the parameter trajectory, where i is an index referring to a current frame:

setting a mel-cepstral coefficient of a first frame of the parameter trajectory to a mean value of a second frame of the parameter trajectory;

determining if the frame is voiced, wherein;

if the segment is unvoiced, setting the mel-cepstral coefficient of the current frame (mcep(i)) to (mcep(i−1)+mcep_mean(i))/2;

if the segment is voiced and is a first frame, then setting mcep(i)=(mcep(i−1)+mcep_mean(i))/2; and if the segment is voiced and is not a first frame, then setting mcep(i)=(mcep(i−1)+mcep delta(i)+mcep_mean(i))/2;

determining if the linguistic segment has ended, wherein:

when the linguistic segment has ended, removing abrupt changes of the parameter trajectory and adjusting global variance; and when the linguistic segment has not ended, incrementing the index i and repeating for the next frame of the parameter trajectory.

7. The method of claim 6, wherein the statistical parameter model is trained by:

converting a speech corpus into a linguistic specification, the speech corpus covering sounds made in a language and the linguistic specification indexing the speech corpus to generate a speech waveform based on spectral speech parameters; and generating the statistical parameter model based on the linguistic specification and a mean and covariance of a probability function fit by the spectral speech parameters.

8. The method of claim 6, wherein the context labels are generated based on linguistic analysis of the input text.

* * * * *